United States Patent [19]

Steenton et al.

[11] Patent Number: 4,863,398

[45] Date of Patent: Sep. 5, 1989

[54] UNIVERSAL ADAPTER FOR OFFICE WALL PANELS

[75] Inventors: George R. Steenton, Fort Worth, Tex.; Rick R. Marks, Danube, Minn.

[73] Assignee: Keptel, Inc., Tinton Falls, N.J.

[21] Appl. No.: 303,903

[22] Filed: Jan. 30, 1989

[51] Int. Cl.[4] ..... H01R 13/74

[52] U.S. Cl. ..... 439/538; 439/550; 439/565

[58] Field of Search ..... 439/536–538, 439/550, 565, 535, 562, 563, 569; 248/27.1

[56] References Cited

PUBLICATIONS

Armiger News Release describing "Duplex Connector for Modular Furniture Applications" (5 pages).

*Primary Examiner*—Gary F. Paumen

*Attorney, Agent, or Firm*—R. Gale Rhodes, Jr.

[57] ABSTRACT

An adapter for establishing electrical connections such as telephone or data line connections includes a face plate sized to fit through a corresponding aperture in a wall panel and a back plate larger than the aperture to abut the rear of the wall panel. A bracket is received about the face plate from the front of the panel. The bracket includes upper and lower projections which are received in corresponding aligned slots on the face plate for mounting the adapter to the face plate.

3 Claims, 1 Drawing Sheet

UNIVERSAL ADAPTER FOR OFFICE WALL PANELS

FIELD OF THE INVENTION

The present invention relates to modular adapters or connectors for office wall panels. More particularly it relates to an apparatus for mounting telephone or data line adapters to office wall panels of many different configurations or manufacture and is therefore referred to as a "universal" adapter.

BACKGROUND OF THE INVENTION

Adapters of the type with which the present invention is concerned are frequently used in offices. In many modern offices there are wall panels or separators dividing offices or work spaces. In these environments, there is a need to route telephone lines and data lines (collectively referred to as "Local Area Networks" or simply, LANs) to and from the locations defined by the office wall panels, and it is desirable to minimize or eliminate cable lying on the floor. Therefore, modern office systems frequently include provisions for routing such cables or wires within the wall panels themselves, and it is common to route Local Area Networks in a wire channel that runs along the bottom interior of an office wall panel. Thus, adapters of the type with which the present invention is concerned are normally mounted in metal (or plastic) channels located at the lower portions of office wall panels.

There are many different manufacturers of office wall panels and even the same manufacturer may have different arrangements for wire channels at the bottom of its office wall panels. The present invention is directed to an adapter for office wall panels which provides a universal mounting for many different types of wire channels in office wall panels.

In the past, mountings for adapters have been uniquely designed for each type or style of wire channel. One such adapter includes a backing plate for the adapter which has extensions or feet which fit into slots formed in the wall of the wire channel. The adapter also has a detent located at the upper portion for snapping into a corresponding recess on the wall panel. Thus, although it is convenient to assemble such an adapter to a wire channel, the arrangement of lower slots and upper recess are unique to a particular model or manufacturer of wall panel, and such an arrangement would require different adapters for each manufacturer or model of wall panel.

SUMMARY OF THE INVENTION

According to the present invention, an adapter has a face plate which is sized to fit through a corresponding aperture in the wire channel of an office wall panel. Conventional telephone or data adapters in any desired configuration may be mounted in the face plate of the adapter. Behind the face plate and extending outwardly of its periphery, the adapter includes a back plate. When the adapter is assembled to an office panel by placing the face plate of the adapter through the corresponding aperture in the wall panel, the back plate, being larger than the aperture in the wall panel, engages the rear surface of the wall panel and limits the insertion of the face plate.

Slots are formed in the top and bottom surfaces of the face plate. These slots may be in the form of limit grooves extending rearwardly of the front surface of the face plate. A bracket is received about the face plate from the front of the wall panel. The bracket includes upper and lower projections which are received in the corresponding aligned limit slots at the top and bottom of the face plate for mounting the adapter to the face plate in a snap-on type of connection with the wall panel sandwiched between the front mounting bracket and the back plate of the adapter. Thus, no special provision on the wall panel is required for mounting the adapter, and the adpater will mount to any vertical wall panel provided there is sufficient room to accommodate it behind the wall panel and the size of the aperture in the wall panel corresponds to the size of the face plate of the adapter.

The presentation can thus be seen to provide a mounting system for an adapter having any connector configuration which may be mounted to any office panel having the required size of opening without the need of special fixtures on the wall panel itself. Moreover, the adapter is easily, quickly and reliably mounted to the office panel without the need for special tools or fittings.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
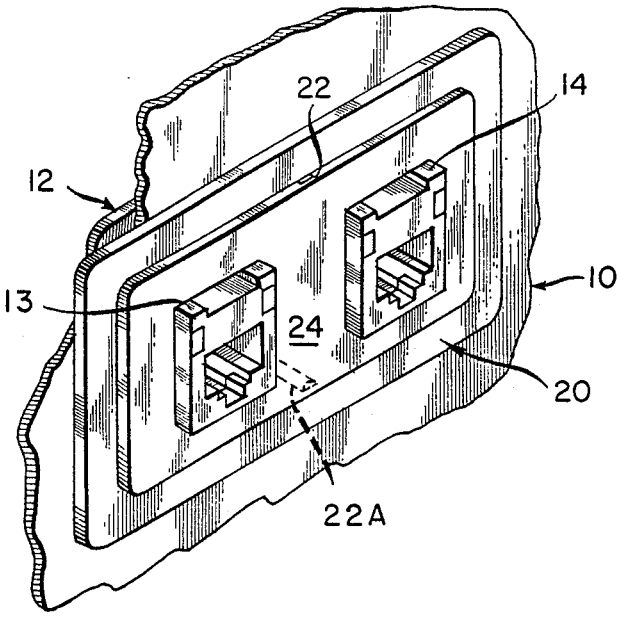
FIG. 1 is an upper perspective of a universal adapter for office wall panels constructed according to the present invention is an assembled form but with the office wall panel shown in fragmentary form.

Referring first to FIG. 1, reference numeral 10 generally designates a vertical outer wall portion of a wire channel located at the base of a conventional office wall panel. The wall 10 may, of course, be an outer wall of any other type of wall channel in which it is desired to mount adapters for electrical connections; but typically, at least, in an modular office panel system, the wall 10 is formed of sheet metal.

Reference numeral 12 generally designates an adapter mounted to the wall 10 for establishing electrical connections. In the illustrated embodiment, the adapter 12 includes first and second conventional telephone jacks 13, 14. Other arrangements of jacks and/or data connectors may equally well be employed.

Figure 2:
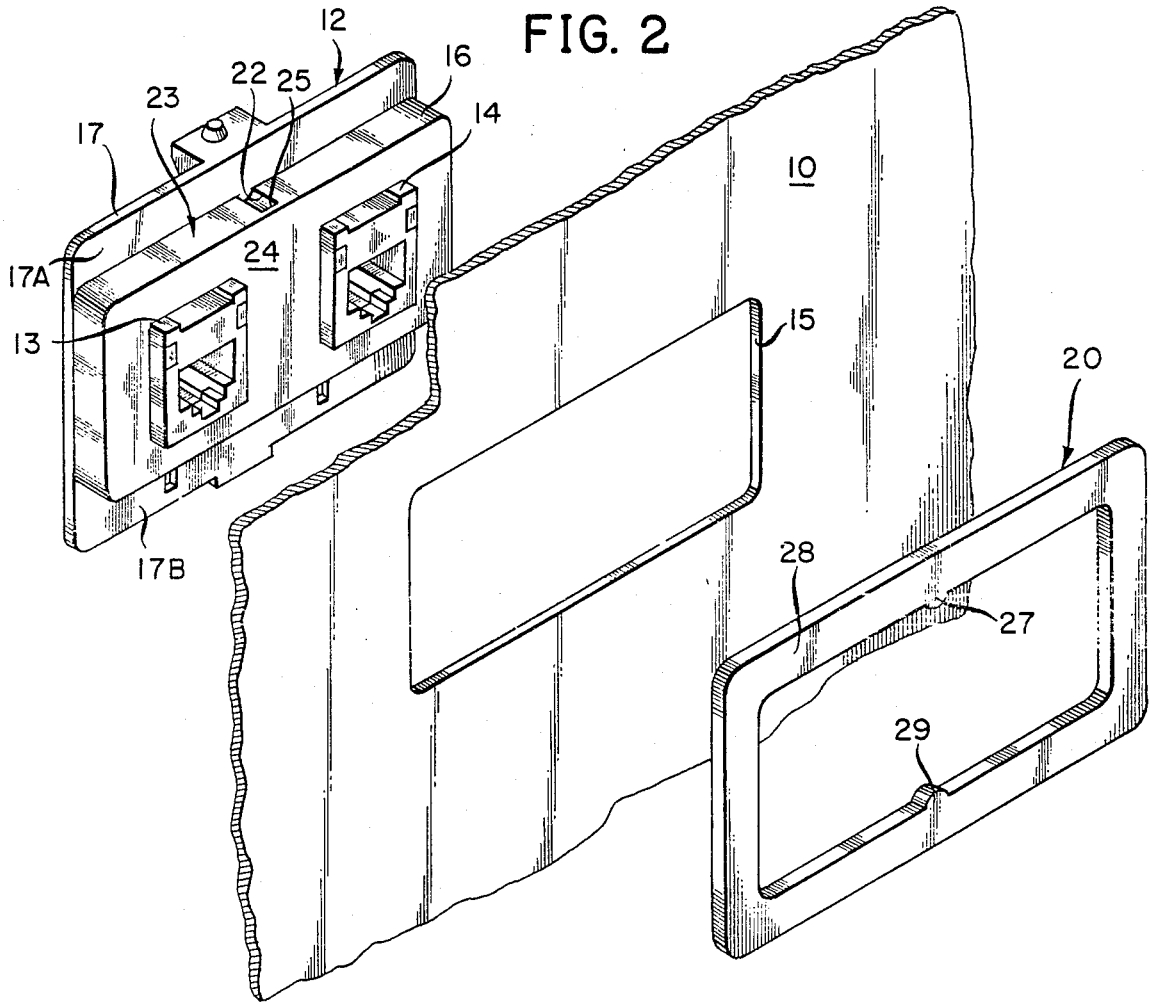
FIG. 2 is an enlarged, exploded view of the elements shown in FIG. 1.

Turning now to FIG. 2, an aperture 15 is formed in the wall 10 for receiving the adapter 12. In particular, the adapter 12 includes a forwardly extending face plate 16 behind which there is located a back plate 17. It will be observed that the back plate 17 has an upper lip 17A and a lower lip 17B which extend respectively above and below the top and bottom of the wall panel aperture 15. That is, the face plate 16 is sized to be received in the aperture 15, but the aperture 15 is not big enough so that the entire adapter 12 can slip through it.

A mounting bracket 20 in the form of a peripheral frame is located in front of the wall panel 10 and assembled to the adapter 12 after the face plate 16 is passed through the aperture 15.

To effect the mounting, a first slot 22 in FIG. 2 is located on the top surface 23 and a second slot seen in phantom and designated 22A (FIG. 1) is located on the bottom surface of the face plate 16. Slots 22, 22A may be vertically aligned. The slots are referred to as "limit slots", meaning that they do not extend entirely through the upper surface 23 into the front surface 24 as indicated by the separation 25. Thus, the slots are formed to limit the withdrawal of the bracket. That is, the separation 25 provides a limit surface for limiting the forward movement of a projection 27 located on the lower portion of the upper segment 28 of the frame 20. A corresponding projection 29 is located beneath the projection 27. The projections 27, 29 extend inwardly of the frame 20 and are received in the upper and lower limit slots 22.

The frame 20 is assembled to the face plate 16 by placing one of the projections into its corresponding limit slot after the face plate has been assembled to the wall panel 10, and the other projection 27, 29 is then forced over the face plate 16 into assembled relation with its corresponding slot 22, 22A in a snap-on assembly. The mounting bracket 20 may be removed in disassembling the face plate by prying it away from the wall 10 with a screwdriver or the like.

It will thus be observed that the adapter 12 may be assembled to a wide variety of office panel systems or wire channels provided only that the aperture 15 of the wall panel will accommodate the base plate 16.

The adapter 12 may include connectors other than the telephone connectors illustrated such as conventional data connectors, and the configuration or number of connectors may vary.

The illustrated adapter 12, other than for the limit slots 22, 22A, is conventional and of the type mentioned above having a lower extension or foot for being received into a slot formed in the rear of a conventional wall panel and an upper projection for receiving in an aperture in snapping engagement at the top of the rear of the wall panel. Such arrangements require unique arrangement of slots and recesses sized to receive a particular adapter and do not have universal application.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. An adapter for mounting to a wall of an office panel provided with an aperture, comprising a body defining a face plate and a back plate behind said face plate, said face plate having at least one electrical connector mounted thereto and defining a pair of opposing limit slots on opposing peripheral surfaces thereof, said slots extending in a fore-and-aft direction relative to the direction of insertion of said adapter when assembled to said wall; and a peripheral mounting bracket adapted to be received on said face plate after said face plate is assembled through said aperture of said wall, said bracket further including at least a pair of opposing projections adapted to be received in said limit slots with said wall being sandwiched between at least a portion of said back plate and said bracket.

2. The apparatus of claim 1 wherein said back plate includes an upper and a lower lift extending respectively above and below said face plate and wherein said face plate projects forwardly of said backing plate and provides a peripheral wall for defining said limit slots.

3. The apparatus of claim 2 wherein said limit slots are located respectively in the upper and lower surfaces of said peripheral wall of said face plate and are aligned vertically relative to one another.

* * * * *